US009113246B2

(12) United States Patent
Bastide et al.

(10) Patent No.: US 9,113,246 B2
(45) Date of Patent: Aug. 18, 2015

(54) AUTOMATED LEFT-RIGHT HEADPHONE EARPIECE IDENTIFIER

(71) Applicant: International Business Machines Corporation, Armonk, NY (US)

(72) Inventors: Paul R. Bastide, Boxford, MA (US); Matthew E. Broomhall, South Burlington, VT (US); Robert E. Loredo, North Miami Beach, FL (US)

(73) Assignee: International Business Machines Corporation, Armonk, NY (US)

( * ) Notice: Subject to any disclaimer, the term of this patent is extended or adjusted under 35 U.S.C. 154(b) by 323 days.

(21) Appl. No.: 13/623,163

(22) Filed: Sep. 20, 2012

(65) Prior Publication Data

US 2014/0079238 A1 Mar. 20, 2014

(51) Int. Cl.
*H04R 1/10* (2006.01)
*H04R 5/033* (2006.01)

(52) U.S. Cl.
CPC ..... *H04R 5/033* (2013.01); *H04R 1/1041* (2013.01); *H04R 1/1091* (2013.01); *H04R 2430/01* (2013.01); *H04S 2420/01* (2013.01)

(58) Field of Classification Search
None
See application file for complete search history.

(56) References Cited

U.S. PATENT DOCUMENTS

| | | | | |
|---|---|---|---|---|
| 7,590,233 | B2 | 9/2009 | Chiloyan | |
| 2004/0042629 | A1 | 3/2004 | Mellone et al. | |
| 2007/0036363 | A1* | 2/2007 | Hollemans et al. | 381/59 |
| 2008/0089539 | A1* | 4/2008 | Ishii | 381/311 |
| 2009/0052704 | A1* | 2/2009 | Schulz | 381/312 |
| 2009/0245549 | A1* | 10/2009 | Jubelirer et al. | 381/309 |
| 2010/0022269 | A1* | 1/2010 | Terlizzi | 455/556.1 |
| 2011/0038484 | A1 | 2/2011 | Macours | |
| 2011/0249854 | A1* | 10/2011 | Nystrêm | 381/370 |
| 2012/0003937 | A1* | 1/2012 | Zhong | 455/41.3 |
| 2012/0114154 | A1* | 5/2012 | Abrahamsson | 381/309 |
| 2012/0171958 | A1* | 7/2012 | Cornett et al. | 455/41.2 |
| 2013/0182867 | A1* | 7/2013 | Knowles | 381/74 |
| 2013/0208927 | A1* | 8/2013 | Wang | 381/306 |
| 2013/0279724 | A1* | 10/2013 | Stafford et al. | 381/309 |

FOREIGN PATENT DOCUMENTS

CN 102064781 A 5/2011

OTHER PUBLICATIONS

Plantonics, Inc., "Automatic Channel Assignment for Stereo Headsets or Headphones", IP.com, Jul. 30, 2009, 4 pages.

* cited by examiner

*Primary Examiner* — Brenda Bernardi
(74) *Attorney, Agent, or Firm* — Jordan IP Law, LLC

(57) ABSTRACT

Methods and systems of automatically identifying left-right earpieces may provide for determining an orientation of a device, and determining an earpiece orientation of a headset relative to the orientation of the device. Additionally, an audio output of the device may be configured based on the earpiece orientation. In one example, the earpiece orientation indicates whether the earpiece is facing either left or right with respect to the device.

20 Claims, 2 Drawing Sheets

FIG. 2
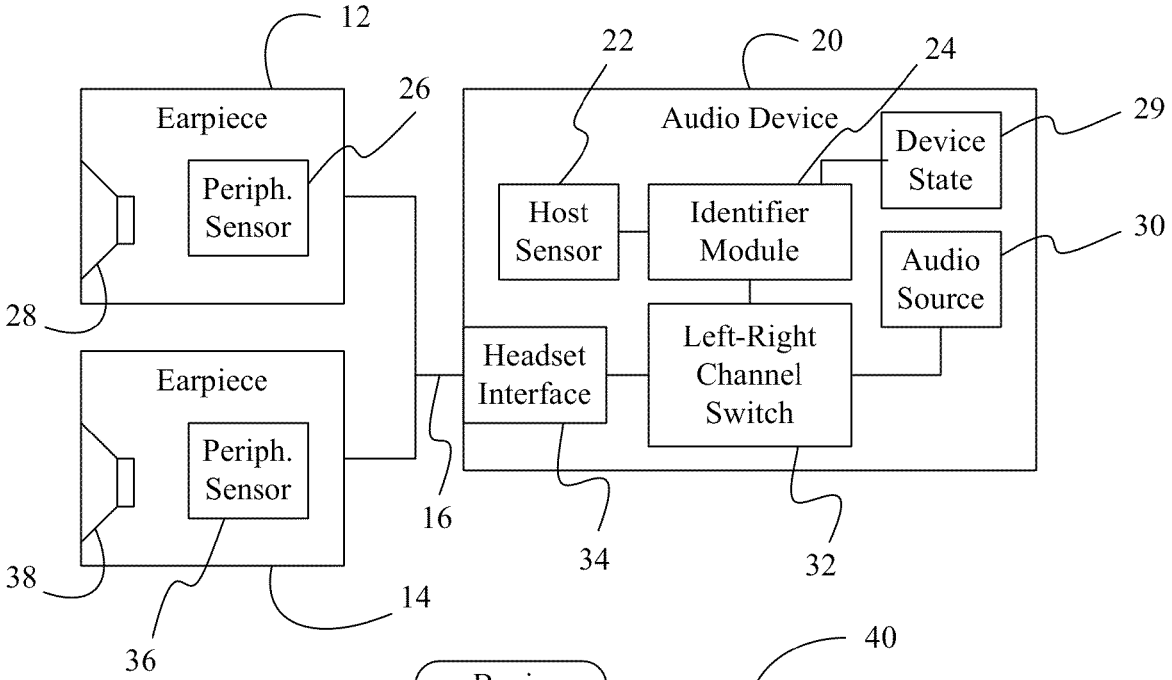
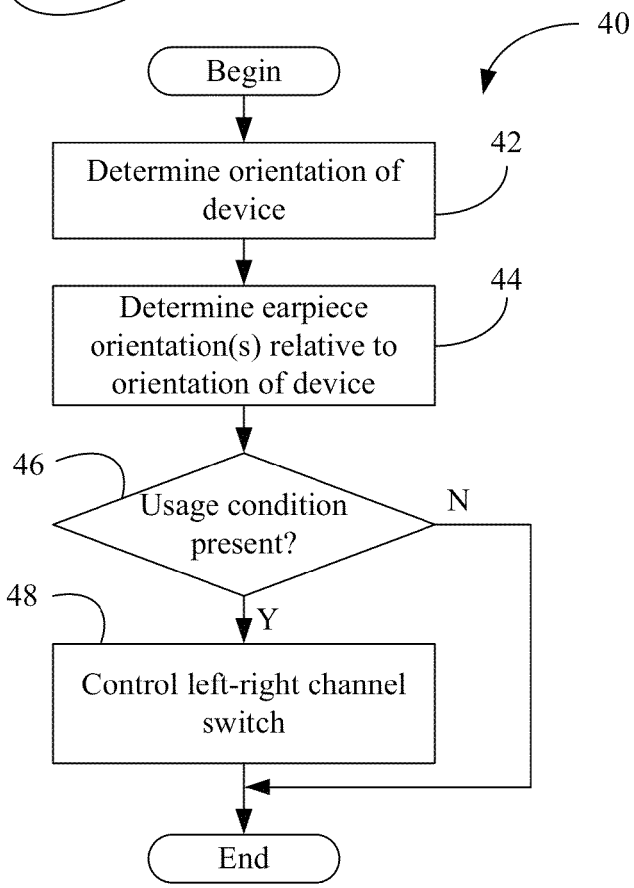
FIG. 3

AUTOMATED LEFT-RIGHT HEADPHONE EARPIECE IDENTIFIER

BACKGROUND

Embodiments of the present invention generally relate to audio output devices. More particularly, embodiments relate to the automatic identification of left-right headset earpieces.

Devices such as computers, media players, smart phones, tablets, etc., may enable users to view and listen to media content such as movies, video games, music, and so forth, wherein the use of headsets/headphones can facilitate the output of corresponding audio content on an individualized basis. To enhance the listening experience, the left and right channels of certain audio content may differ depending on the type of media being experienced (e.g., an action movie with a train traveling left-to-right in the scene, a video game with a car moving right-to-left, etc.). In some cases, however, it may be difficult for the user to determine which earpiece of the headset belongs in the left ear and which earpiece belongs in the right ear. While marking the earpieces with a left-right identifier may be helpful, such markings can wear over time and may be impractical if there is limited space on the earpieces.

BRIEF SUMMARY

Embodiments may include a method in which an orientation of a device is determined. The method may also provide for determining a first earpiece orientation of a headset relative to the orientation of the device, and configuring an audio output of the device based on the first earpiece orientation.

Embodiments may include a computer program product having a computer readable storage medium and computer usable code stored on the computer readable storage medium. If executed by a processor, the computer usable code may cause a device to determine an orientation of the device based on a signal from a host sensor embedded in the device. The computer usable code may also cause the device to determine a first earpiece orientation of a headset relative to the orientation of the device based on a signal from a peripheral sensor embedded in a first earpiece of the headset, wherein the first earpiece orientation is to indicate whether the first earpiece is facing either left or right with respect to the device. Additionally, the computer usable code may cause the device to determine a second earpiece orientation of the headset relative to the device based on a signal from a peripheral sensor embedded in a second earpiece of the headset, wherein the second earpiece orientation is to indicate whether the second earpiece is facing either left or right with respect to the device. In addition, the computer usable code can cause the device to control a left-right channel switch associated with the audio output based on the first earpiece orientation and the second earpiece orientation.

Embodiments may also include a device having a host sensor, a left-right channel switch associated with an audio output, a headset interface coupled to the left-right channel switch, and an identifier module to determine an orientation of the device based on a signal from the host sensor. The identifier module may also determine a first earpiece orientation of a headset relative to the orientation of the device based on a signal from a peripheral sensor embedded in a first earpiece of the headset, wherein the first earpiece orientation is to indicate whether the first earpiece is facing either left or right with respect to the device. Additionally, the identifier module can determine a second earpiece orientation of the headset relative to the device based on a signal from a peripheral sensor embedded in a second earpiece of the headset, wherein the second earpiece orientation is to indicate whether the second earpiece is facing either left or right with respect to the device. In addition, the identifier module may control the left-right channel switch based on the first earpiece orientation and the second earpiece orientation.

BRIEF DESCRIPTION OF THE SEVERAL VIEWS OF THE DRAWINGS

The various advantages of the embodiments of the present invention will become apparent to one skilled in the art by reading the following specification and appended claims, and by referencing the following drawings, in which:

FIG. 2 is a block diagram of an example of a headset and audio device configuration according to an embodiment; and FIG. 3 is a flowchart of an example of a method of automatically identifying left-right earpieces according to an embodiment.

DETAILED DESCRIPTION

Figure 1A:
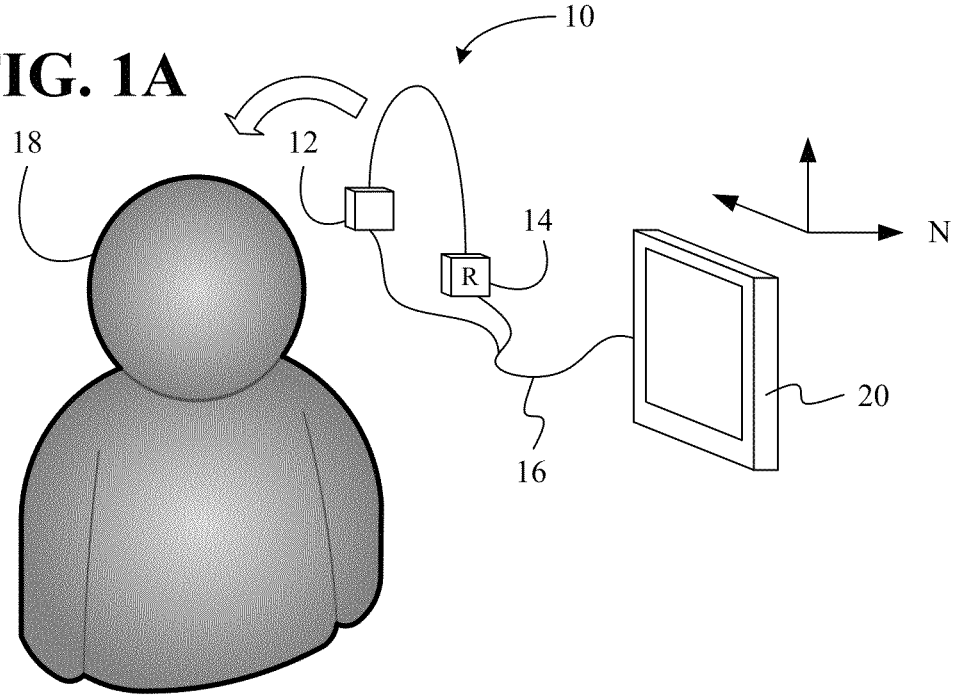
FIGS. 1A and 1B are illustrations of a headset according to an embodiment.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 1B:
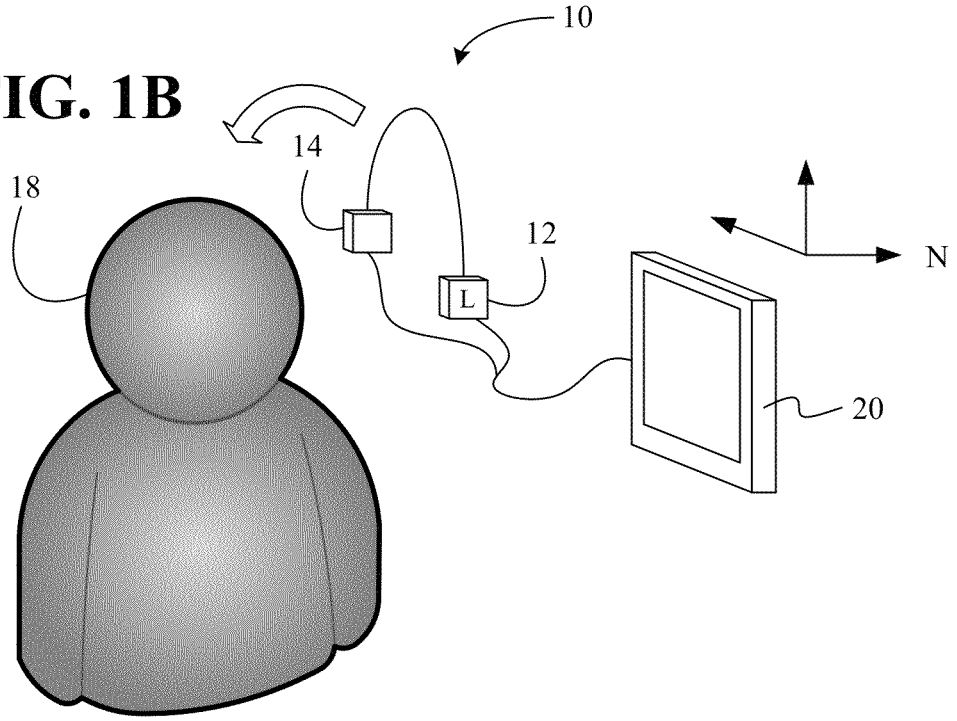

Referring now to FIG. 1A, a headset 10 is shown, wherein the headset 10 includes a left earpiece/earbud 12 and a right earpiece 14. In the illustrated example, the earpieces 12, 14 are coupled (e.g., plugged into) a device 20 via one or more cables 16. The earpieces 12, 14 may also be wirelessly coupled to the device 20 (e.g., via Bluetooth) so that any need for the cable 16 may be obviated. The device 20, which may be, for example, a smart phone, tablet, media player, personal digital assistant (PDA), or any combination thereof, can deliver audio signals to the earpieces 12, 14 in conjunction with the playing of media content such as music, movies, video games, and so forth. The earpieces 12, 14, may in turn convert the audio signals into sound. In the illustrated example, a user 18 is about to put on the headset 10 correctly so that the right earpiece 14 delivers sound to the right ear of the user 18 and the left earpiece 12 delivers sound to the left ear of the user 18. FIG. 1B, on the other hand, shows a scenario in which the user 18 is about to put on the headset 10 backwards so that the left earpiece 12 delivers sound to the right ear of the user 18 and the right earpiece 14 delivers sound to the left ear of the user. As will be discussed in greater detail, the illustrated device 20 may be configured to automatically detect that the headset 10 is being worn backwards by the user 18 and switch the left-right audio channels associated with the audio signals delivered to the earpieces 12, 14 so that the user 18 experiences the audio content as intended by the developer of the audio content.

More particularly, the illustrated device 20 is able to determine whether the left earpiece 12 is facing either left or right with respect to the device 20. Thus, if the rear of the device 20 is facing North and the back of the left earpiece 12 is facing East (as in FIG. 1B), it may be determined that the left earpiece 12 is facing left with respect to the device 20 and is therefore being worn on the right ear of the user 18 (i.e., incorrectly/backwards). By contrast, if the rear of the device 20 is facing North and the back of the left earpiece 12 is facing West (as in FIG. 1A), it may be determined that the left earpiece 12 is facing right with respect to the device 20 and is therefore being worn in the left ear of the user 18 (i.e., correctly). As will be discussed in greater detail, sensors embedded in the left earpiece 12 and the device 20, respectively, may be used to facilitate such a determination.

Similarly, the device 20 may be able to determine whether the right earpiece 14 is facing either left or right with respect to the device 20. Thus, if the rear of the device 20 is facing North and back of the right earpiece 14 is facing East (as in FIG. 1A), it may be determined that the right earpiece 14 is being worn correctly in the right ear of the user 18, whereas if the back of the right earpiece is facing West (as in FIG. 1B), it may be determined that the right earpiece 14 is being worn incorrectly in the left ear of the user 18. Of particular note is that the orientation of the earpieces 12, 14 may be determined relative to the orientation of the device 14. As a result, the illustrated approach is able to detect the headset orientations in a wide variety of scenarios such as, for example, the user lying down, headband-connected earpieces that may be worn backwards without being turned upside down, etc. Indeed, the relative angle (e.g., tilt) between the earpieces 12, 14 and the device 20 may also be determined and used to configure the audio output. For example, if the user 18 looks down at the device 20 while tilting the device 20 at a certain angle to view the display of the device 20, such a condition may still result in accurate orientation determinations because the earpiece orientations are made relative to the orientation of the device 20.

FIG. 2 shows a more detailed example of the interaction between the earpiece 12, 14 and the audio device 20. In the illustrated example, the audio device 20 includes a host sensor 22 such as an accelerometer, gyroscope, etc., and an identifier module 24 configured to determine the orientation of the device 20 based on one or more signals from the host sensor 22. Additionally, the left earpiece 12 may include a peripheral sensor 26 (e.g., accelerometer, gyroscope) embedded therein, wherein the identifier module 24 can determine the orientation of the left earpiece 12 relative to the device 20 based on one or more signals from the peripheral sensor 26. The signals from the peripheral sensor 26 may be transmitted to the device 20 via the cable 16 or wirelessly (e.g., via Bluetooth).

In one example, the orientation of the left earpiece 12 indicates whether the left earpiece 12 is facing either left or right with respect to the device 20, as already discussed. The device 20 may further include an audio source 30 (e.g., flash memory, network interface), a left-right channel switch 32, and a headset interface 34, wherein the identifier module 24 may control the left-right channel switch 32 based on the left earpiece orientation so that the left-right channel of the audio output is configured to deliver audio content from the source 30 to the correct earpieces. The control of the left-right channel switch 32 may also take into consideration various device usage conditions/states, as will be discussed in greater detail. In this regard, the illustrated audio device 20 further includes a device state module 29 that provides state information to the identifier module 24, wherein the identifier module 24 might only control the left-right channel switch 32 if the state information indicates that the user is making audio adjustments such as selecting content or adjusting volume. Such a device usage condition could be indicative of the user looking at the device 20 so that the relative orientation determinations may be considered to be more accurate. The illustrated left earpiece 12 also includes a speaker 28 to deliver sound to the ear canal of the user.

The illustrated right earpiece 14 also includes a speaker 38 and a peripheral sensor 36 (e.g., accelerometer, gyroscope) embedded therein, wherein the identifier module 24 may determine the orientation of the right earpiece 14 relative to the device 20 based on one or more signals from the peripheral sensor 36. The signals from the peripheral sensor 36 may also be transmitted to the device 20 via the cable 16 or over a wireless link. Thus, the orientation of the right earpiece 12 may indicate whether the right earpiece 14 is facing either left or right with respect to the device 20, wherein the identifier module 24 can further control the left-right channel switch 32 based on the right earpiece orientation so that the left-right channel of the audio output is configured to deliver audio content from the source 30 to the correct earpieces. Thus, the identifier module 24 may use either one or both of the earpieces 12, 14 to control the delivery of audio content. The use of orientation information for both earpieces 12, 14 may enhance accuracy, particularly if the user only listens to one earpiece.

Turning now to FIG. 3, a method 40 of automatically identifying left-right earpieces is shown. The method 40 may be implemented in an identifier module such as, for example, the identifier module 24 (FIG. 2), already discussed. Illustrated processing block 42 provides for determining an orientation of the device. In one example, the orientation of the device is determined based on a signal from a host sensor embedded in the device. Earpiece orientations of a headset may be determined relative to the orientation of the device at block 44, wherein the earpiece orientations can indicate whether the headset earpieces are facing left or right relative to the device.

Block 46 may detect a particular device usage condition such as the user facing a display of the device. For example, the earpiece orientation information, which may indicate whether the earpieces are facing either left or right relative to the device as well as the angle of the earpieces relative to the device, can be used to determine whether the device usage condition is present. As already noted, additional information such as device state information may be used to determine whether the user is making audio adjustments on the device and further improve the reliability of the device usage condition determination. Other device usage conditions, such as the user separating the earpieces from one another (e.g., unraveling earbuds), may also be used. In such a case the orientation of the two earpieces may be used to detect an earpiece separation event. If it is determined that the device usage condition is present, illustrated block 48 provides for controlling a left-right channel switch associated with the audio output. Otherwise, the channel control process may be bypassed.

Techniques described herein may therefore improve user experience and accessibility through natural association of audio content with left and right audio outputs. Such a solution could be particularly advantageous in audio mixing applications for hearing deficient users (e.g., user is nearly deaf in the left ear and sets the system to boost volume in the right ear—backwards earpieces may otherwise lead to ear damage) as well as for visual components (e.g., user is watching a movie with a left-to-right audio effect—backwards earpieces may otherwise cause the effect to be right-to-left). Moreover, audio cues, guides and/or alerts coming from a particular direction may be assured to come from the correct direction using the techniques described herein.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions. In addition, the terms "first", "second", etc. may be used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. A device comprising:

a host sensor;

a left-right channel switch associated with an audio output;

a headset interface coupled to the left-right channel switch; and an identifier module to, determine an orientation of the device based on a signal from the host sensor, determine a first earpiece orientation of a headset relative to the orientation of the device based on a signal from a peripheral sensor embedded in a first earpiece of the headset, wherein the first earpiece orientation is to indicate whether the first earpiece is facing either left or right with respect to the device, determine a second earpiece orientation of the headset relative to the device based on a signal from a peripheral sensor embedded in a second earpiece of the headset, wherein the second earpiece orientation is to indicate whether the second earpiece is facing either left or right with respect to the device; and control the left-right channel switch based on the first earpiece orientation and the second earpiece orientation.

2. The device of claim 1, wherein the identifier module is to use the first earpiece orientation and the second earpiece orientation to detect an earpiece separation event, and wherein the audio output is to be configured in response to the earpiece separation event.

3. The device of claim 1, wherein the identifier module is to use the first earpiece orientation and the second earpiece orientation to detect a device usage condition, wherein the audio output is to be configured in response to the device usage condition.

4. The device of claim 3, wherein the device usage condition is to include a user of the device facing a display of the device.

5. The device of claim 4, wherein the device usage condition is to further include a user of the device making an audio adjustment on the device.

6. A computer program product comprising:

a non-transitory computer readable storage medium; and computer usable code stored on the non-transitory computer readable storage medium, where, if executed by a processor, the computer usable code causes a device to:

determine an orientation of the device based on a signal from a host sensor embedded in the device;

determine a first earpiece orientation of a headset relative to the orientation of the device based on a signal from a peripheral sensor embedded in a first earpiece of the headset, wherein the first earpiece orientation is to indicate whether the first earpiece is facing either left or right with respect to the device;

determine a second earpiece orientation of the headset relative to the device based on a signal from a peripheral sensor embedded in a second earpiece of the headset, wherein the second earpiece orientation is to indicate whether the second earpiece is facing either left or right with respect to the device; and control a left-right channel switch associated with the audio output based on the first earpiece orientation and the second earpiece orientation.

7. The computer program product of claim 6, wherein the computer usable code, if executed, causes the device to use the first earpiece orientation and the second earpiece orientation to detect an earpiece separation event, and wherein the audio output is to be configured in response to the earpiece separation event.

8. The computer program product of claim 6, wherein the computer usable code, if executed, causes the device to use the first earpiece orientation and the second earpiece orientation to detect a device usage condition, wherein the audio output is to be configured in response to the device usage condition.

9. The computer program product of claim 8, wherein the device usage condition is to include a user of the device facing a display of the device.

10. The computer program product of claim 9, wherein the device usage condition is to further include a user of the device making an audio adjustment on the device.

11. A method comprising:

determining an orientation of a device;

determining a first earpiece orientation of a headset relative to the orientation of the device; and configuring an audio output of the device based on the first earpiece orientation.

12. The method of claim 11, wherein the orientation of the device is determined based on a signal from a host sensor embedded in the device.

13. The method of claim 11, wherein the first earpiece orientation is determined based on a signal from a peripheral sensor embedded in a first earpiece of the headset.

14. The method of claim 13, wherein the first earpiece orientation indicates whether the first earpiece is facing either left or right with respect to the device.

15. The method of claim 11, wherein configuring the audio output includes controlling a left-right channel switch associated with the audio output.

16. The method of claim 11, further including determining a second earpiece orientation of the headset relative to the device, wherein the audio output is configured further based on the second earpiece orientation.

17. The method of claim 16, further including using the first earpiece orientation and the second earpiece orientation to detect an earpiece separation event, wherein the audio output is configured in response to the earpiece separation event.

18. The method of claim 11, further including using the first earpiece orientation to detect a device usage condition, wherein the audio output is configured in response to the device usage condition.

19. The method of claim 18, wherein the device usage condition includes a user of the device facing a display of the device.

20. The method of claim 19, wherein the device usage condition further includes the user of the device making an audio adjustment on the device.

* * * * *